US005385257A

United States Patent [19]

Hung

[11] Patent Number: 5,385,257

[45] Date of Patent: Jan. 31, 1995

[54] POT WITH IMPROVED CONFIGURATION

[76] Inventor: Chi-Tsan Hung, 207, Alley 270, Lane 36, Section 4, An-Ho Road, Tainan, Taiwan, Prov. of China

[21] Appl. No.: 177,754

[22] Filed: Jan. 4, 1994

[51] Int. Cl.[6] ..... A47J 27/00; A47J 27/08; A47J 27/09; B65D 51/16

[52] U.S. Cl. ..... 220/324; 99/403; 99/467; 220/315; 220/337; 220/344; 220/912

[58] Field of Search ..... 99/369, 403, 337, 467; 126/369, 373, 390; 220/314, 315, 316, 318, 321, 334, 324, 326, 337-340, 342, 344, 912; 292/286, 256.5

[56] References Cited

U.S. PATENT DOCUMENTS

| | | | |
|---|---|---|---|
| 985,016 | 2/1911 | Donnell | 220/324 |
| 3,612,335 | 10/1971 | Schurman | 220/324 |
| 4,570,816 | 2/1986 | Ferris et al. | 220/314 |
| 4,917,261 | 4/1990 | Borst | 220/324 |
| 4,941,588 | 7/1990 | Flider | 220/315 |
| 5,002,196 | 3/1991 | Bassili | 220/315 |
| 5,103,994 | 4/1992 | Doxey et al. | 220/318 |
| 5,125,697 | 6/1992 | Kahl et al. | 220/324 |
| 5,205,413 | 4/1993 | Cautereels et al. | 220/324 |
| 5,251,542 | 10/1993 | Itoh et al. | 99/403 |
| 5,293,813 | 3/1994 | Schultz | 99/403 |

*Primary Examiner*—Timothy F. Simone

[57] ABSTRACT

A pot with improved configuration comprises a lid, a pot body, a positioning plate and clipping plate which are all made from plastic material. The lid has a positioning block at one end and a retaining block at the other end. A receiving support is disposed at the top portion of the pot body. The retaining block of the lid is pivoted to the receiving support by a pin member. This pot body further comprises a pivoting block and stopping plate at the circumference. Those positioning plate and clipping plate are pivoted to the pot body by a pair of pins. A retaining block is provided at the top of the positioning plate with respect to the shape of the positioning block. A cutout is provided at the underside of the retaining block. This cutout further includes a pair of pivoting holes thereof. A tab member is provided at the front portion of the clipping plate with respect to the cutout of the retaining block. A through hole is provided at the underside of the tab with respect to the pivoting hole of the retaining plate. A cutout is provided at the top position with respect to the pivoting block. This cutout has a hole thereof. An actuating clip is disposed at the clipping plate. This actuating clip can be firmly received by the stopping plate of the pot body for retaining or releasing the lid to or from the pot body. By assembling these above described elements, a pot can be easily manufactured and assembled.

1 Claim, 5 Drawing Sheets

POT WITH IMPROVED CONFIGURATION

BACKGROUND OF THE INVENTION

This invention relates to a pot, more particularly, to a pot with improved configuration which can be easily assembled and readily utilized.

The conventional pot for preserving food, as shown in FIGS. 1 and 2, comprises a pot body 10 which has an annual slot 100 at the upper portion. A clipping ring 11 is disposed at the annual slot 100. This clipping ring 11 is fastened by a fastener at one end. Besides, a sealing 13 is disposed at the lower portion of the lid 12 to prevent it from leakage. On the other hand, a positioning slot 120 which receives a positioning ring 14 is disposed at the middle portion of the pot body 10. When the lid 12 is attached to the pot body 10, the lug 140 of the positioning ring 14 is pivoted to the positioning hole 111 of the clipping ring 11.

In utilization, the rectangular hooker 112 is engaged with the hooking body 141 of the positioning ring 14, accordingly, the button 113 which moves upward is pressed downward, then the lid 12 and the pot body 10 are engaged together. But those elements are made individually and assembled later, as a result, the cost is high and it takes a great deal of material as well.

SUMMARY OF THE INVENTION

It is the object of this invention to provide a pot with improved pot which can be easily manufactured and assembled.

In order to achieve the goal set forth, the pot with improved configuration comprises a lid, a pot body, a positioning plate and clipping plate which are all made from plastic material. The lid has a positioning block at one end and a retaining block at the other end. A receiving support is disposed at the top portion of the pot body. The retaining block of the lid is pivoted to the receiving support by a pin member. This pot body further comprises a pivoting block and stopping plate at the circumference. Those positioning plate and clipping plate are pivoted to the pot body by a pair of pins. A retaining block is provided at the top of the positioning plate with respect to the shape of the positioning block. A cutout is provided at the underside of the retaining block. This cutout further includes a pair of pivoting holes thereof. A tab member is provided at the front portion of the clipping plate with respect to the cutout of the retaining block. A through hole is provided at the underside of the tab with respect to the pivoting hole of the retaining plate. A cutout is provided at the top position with respect to the pivoting block. This cutout has a hole thereof. An actuating clip is disposed at the clipping plate. This actuating clip can be firmly received by the stopping plate of the pot body for retaining or releasing the lid to or from the pot body.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of a pot with improved configuration. In the drawings.

DETAILED DESCRIPTION OF A PREFERABLE EMBODIMENT

Figure 1:
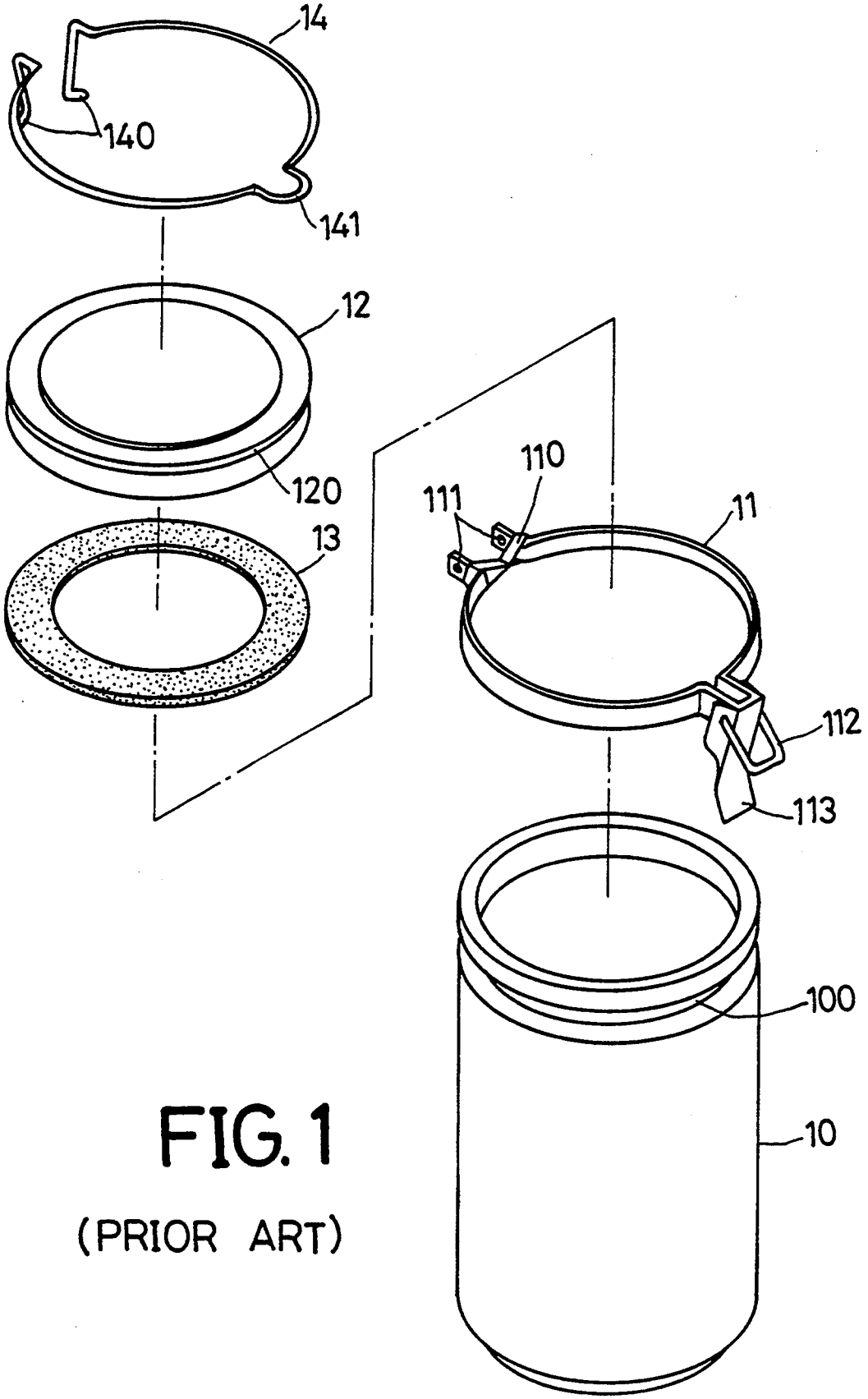
FIG. 1 (PRIOR ART)
FIG. 1 is an exploded perspective view of a conventional pot.
Figure 2:
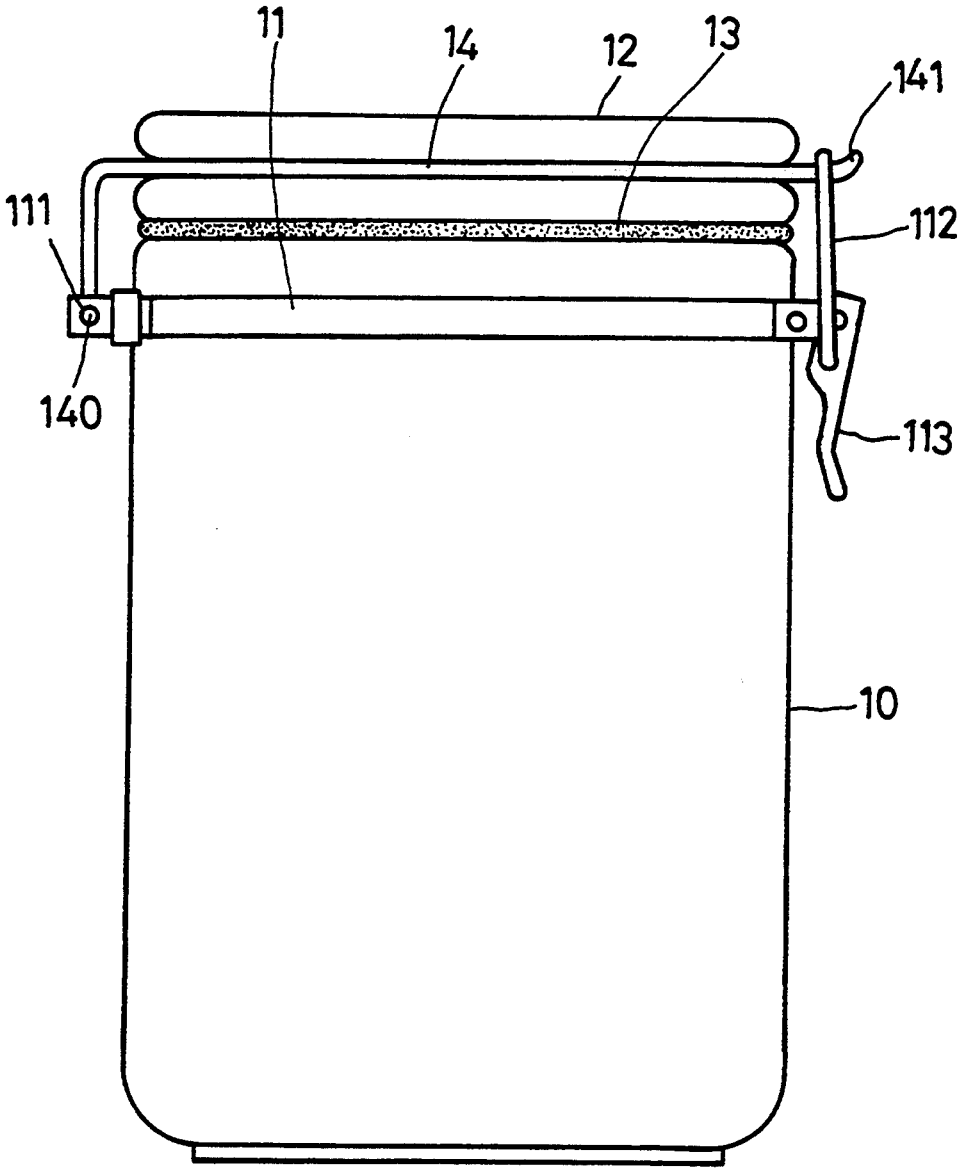
FIG. 2 (PRIOR ART)
FIG. 2 is a front view of a conventional pot.
Figure 3:
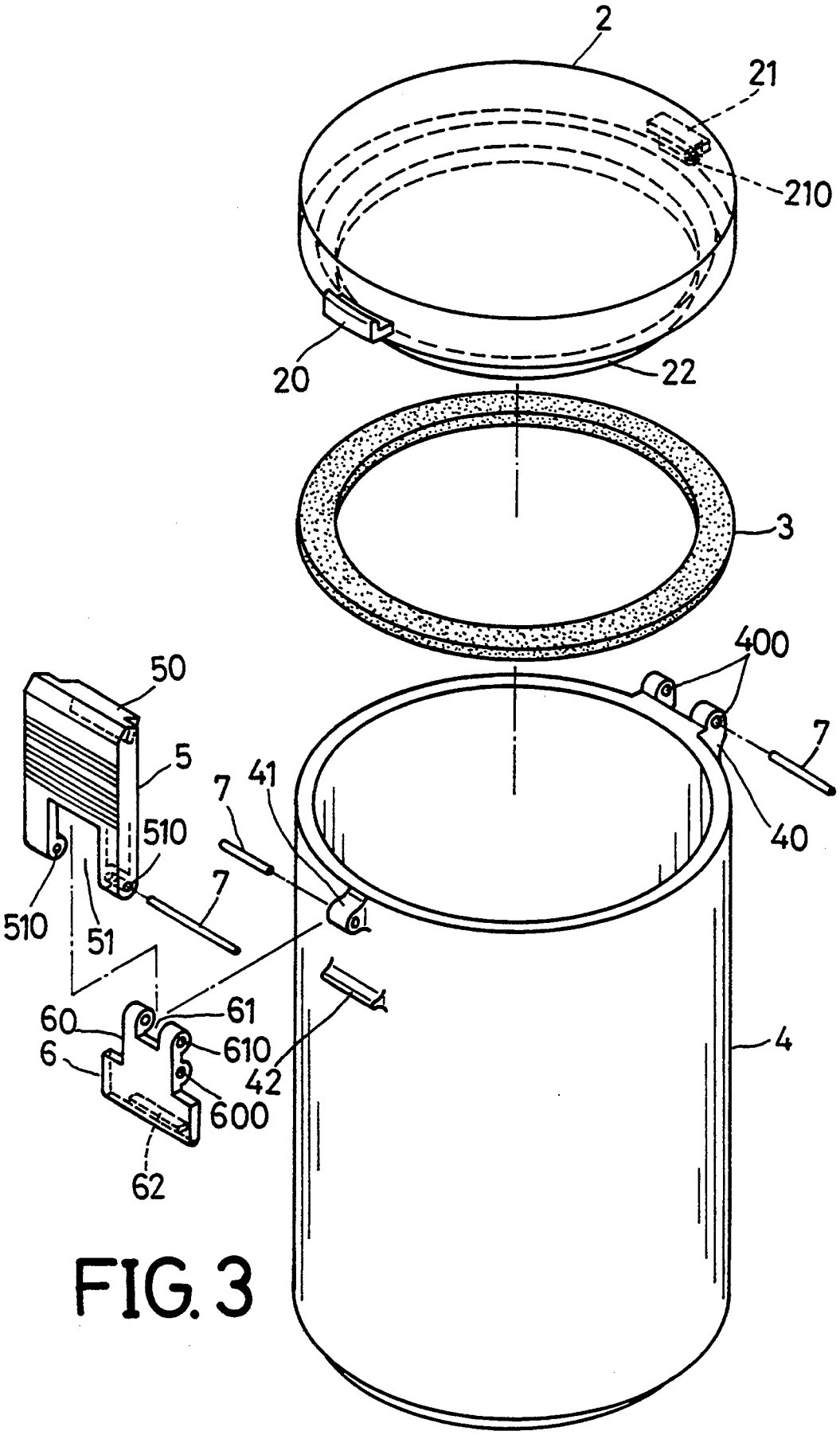
FIG. 3 is a perspective exploded view of the pot made according to this invention.

Referring to FIG. 3, the pot with improved configuration made according to this invention comprises a lid 2, a pot body 4, a positioning plate 5, clipping plate 6, a sealing ring 3 and a plurality of positioning pins 7 which are all made from plastic material. The lid 2 has a positioning block 20 at one end and a retaining block 21 at the other end. This retaining block 21 further includes a through hole 210 thereof. A projected flange 22 is disposed at the underside for receiving the sealing ring 3. This sealing ring 3 can construct a air-tight engagement between the lid 2 and pot body 4. A receiving support 40 is disposed at the top portion of the pot body. The retaining block 21 of the lid 2 is pivoted to the receiving support 40 by a pin member 7 which passes the hole 400 of the receiving support 40. This pot body 4 further comprises a pivoting block 41 and stopping plate 42 at the circumference. Those positioning plate 5 and clipping plate 6 are pivoted to the pot body 4 by a pair of pins 7. A retaining block 50 is provided at the top of the positioning plate 5 with respect to the shape of the positioning block 20 of the lid 2. A cutout 51 is provided at the underside of the retaining block 50. This cutout 51 further includes a pair of pivoting holes 510 thereof. A tab member 60 is provided at the front portion of the clipping plate 6 with respect to the cutout 51 of the retaining plate 5. A through hole 600 is provided at the underside of the tab 60 with respect to the pivoting hole 510 of the retaining plate 5. A cutout 61 is provided at the top position with respect to the pivoting block 41. This cutout 61 has a hole 610 thereof. An actuating clip 62 is disposed at the clipping plate 6. This actuating clip 62 can be firmly received by the stopping plate 42 of the pot body 4 for retaining or releasing the lid 2 to or from the pot body 4.

In assembling, the sealing ring 3 is retained to the flange portion 22 of the lid 2. Then the retaining block 21 is attached to the receiving support 40 of the pot body 4 such that the pin 7 is inserted and retained in the holes 210 and 400. By this arrangement, the lid 2 is pivoted to the pot body 4. Besides, the cutout 61 of the clipping plate 6 is aligned to the pivoting block 41 of the pot body 4 such that the pin 7 is inserted and retained in the hole 610 of the clipping plate 6. At last, the cutout 51 of the positioning plate 6 is aligned to the tab member 60 of the clipping plate 6 such that the pin 7 is inserted and retained into the holes 600 and 500. Then the assembly of pot with improved configuration is completed.

Figure 4:
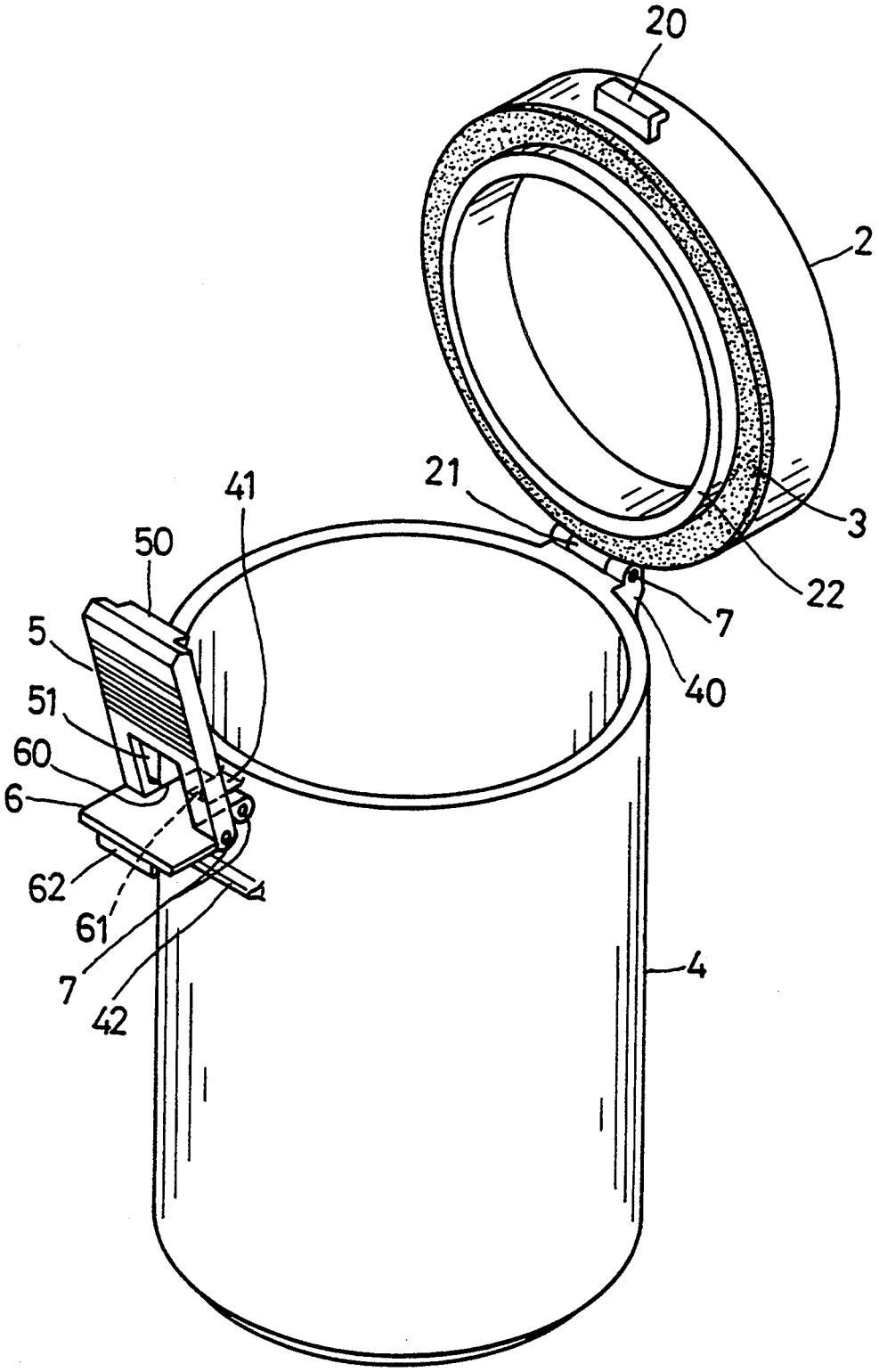
FIG. 4 is a assembled perspective view of the pot made according to this invention.
Figure 5:
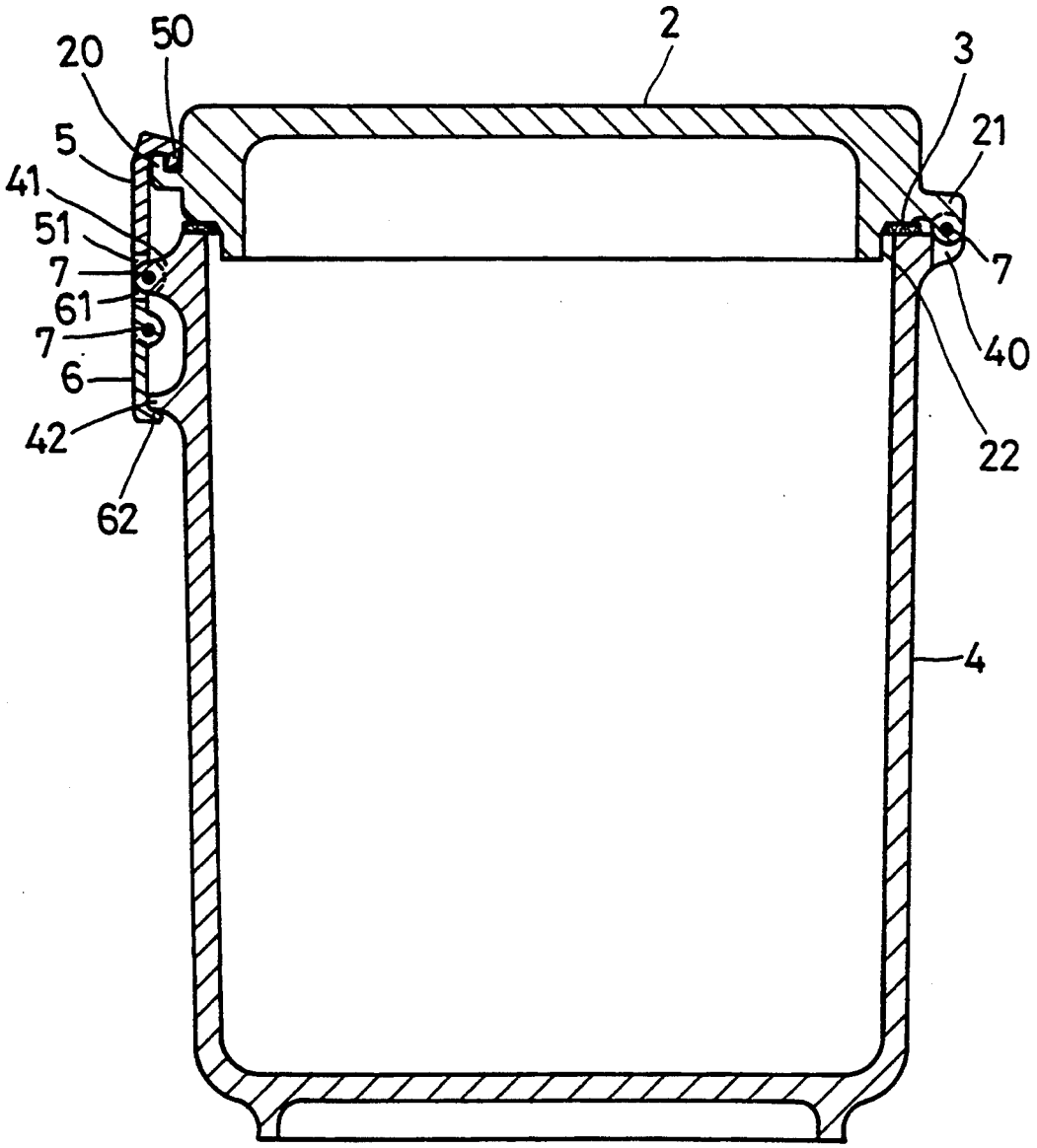
FIG. 5 is a cross sectional view of the pot made according to this invention.

Referring to FIGS. 4 and 5, in using the pot made according to this invention, the food can be put into the pot body 4. Then the lid 2 can be covered to the upper portion of the pot 4 such that the retaining block 50 of the positioning plate 5 engages with the positioning block 20 of the lid 2. When the retaining plate 6 is further depressed, the actuating clip 62 of the retaining plate 6 is engaged with the stopping plate 42 of the pot body 4. By this arrangement, the lid 2 is firmly retained to the pot body 4.

If the user would like to release the lid 2 from the pot 4, the actuating clip 62 shall be firstly released from the stopping plate 42, consequently the positioning plate 5 is moved upward. As a result, the retaining block 50 is released from the positioning block 20. Then the lid can be easily released from the pot body 4.

The pot with improved configuration can be concluded with the following advantages.

1. The manufacturing process is simplified and the material used is largely reduced.

2. The assembly of the pot is easily and readily and the result of the sealing effect is excellent.

Although the present invention has been described in connection with preferred embodiment thereof, many other variations and modifications will now become apparent to those skilled in the art without departing from the scope of the invention. It is preferred, therefore, that the present invention not be limited by the specific disclosure herein, but only by the appended claim.

I claim:

1. A pot with improved configuration comprising a lid, a pot body, a sealing ring, a positioning plate and clipping plate which are all made from plastic material, a projected flange portion being disposed at the underside of the lid for receiving said sealing ring and consequently forming an air-tight engagement between said lid and said pot, said lid having a positioning block at one end and a retaining block at the other end, a receiving support being disposed at the top portion of the pot body, said retaining block of the lid being pivoted to the receiving support by a pin member, said pot body further comprising a pivoting block and stopping plate at the circumference, said positioning plate and clipping plate being pivoted to the pot body by a pair of pins, a retaining block being provided at the top of the positioning plate with respect to the shape of the positioning block, a cutout being provided at the underside of the retaining block, said cutout further including a pair of pivoting holes thereof, a tab member being provided at the front portion of the clipping plate with respect to the cutout of the retaining block, a through hole being provided at the underside of the tab with respect to the pivoting hole of the retaining plate, a cutout being provided at the top position with respect to the pivoting block, said cutout having a hole thereof, an actuating clip being disposed at the clipping plate, said actuating clip being firmly received by the stopping plate of the pot body for retaining or releasing the lid to or from the pot body.

* * * * *